United States Patent [19]

Conrad

[11] Patent Number: 4,480,427

[45] Date of Patent: Nov. 6, 1984

[54] NOSE BAND

[75] Inventor: Ulrich Conrad, Worpswede, Fed. Rep. of Germany

[73] Assignee: Kannemeier & Koch GmbH, Fed. Rep. of Germany

[21] Appl. No.: 493,624

[22] Filed: May 11, 1983

[30] Foreign Application Priority Data

May 11, 1982 [DE] Fed. Rep. of Germany ..... 3217597

[51] Int. Cl.[3] ..... B68B 1/04

[52] U.S. Cl. ..... 54/6 R; 54/24

[58] Field of Search ..... 54/6 R, 6 A, 7, 8, 24, 54/85

[56] References Cited

U.S. PATENT DOCUMENTS

| | | | |
|---|---|---|---|
| 81,395 | 8/1868 | Miller | 54/7 |
| 140,010 | 6/1873 | Carpenter | 54/7 |
| 2,347,752 | 5/1944 | Schmelz | 54/6 R |

FOREIGN PATENT DOCUMENTS

| | | | |
|---|---|---|---|
| 215955 | 11/1908 | Fed. Rep. of Germany . | |
| 30553 | 3/1920 | Norway | 54/6 R |
| 116846 | 7/1946 | Sweden | 54/6 R |

*Primary Examiner*—Robert P. Swiatek

*Attorney, Agent, or Firm*—Allegretti, Newitt, Witcoff & McAndrews, Ltd.

[57] ABSTRACT

The invention concerns a halter having a halter clamp connecting to a nosepiece, a head piece and two chin straps which are suspended in eyelets on both ends and between the ends of the clamp body. In order to avoid the danger of the origin of chafe marks on the horse's head and the danger of collisions with the harness bit snaffle ring, the clamp body of the halter clamp is crescent-shaped in the plane of the horse's head against which the clamp lies, and also laterally curved away from the horse's head. The upper eyelet is preferably round and is provided for suspension of the upper chin strap as well as of the halter head piece. Spindles on this eyelet serve for better fixing of the halter parts. The lower chin strap is fastened to the lower eyelet and the nose piece is fastened to the middle eyelet.

2 Claims, 3 Drawing Figures

NOSE BAND

This invention relates to a nose band for horses having an improved nose band bow for securing the head piece, the nose piece and the chin straps.

A so-called Hannover nose band is known in which the nose band straps are fastened to a ring eyelet. In this construction, the chin strip frequently collides with the harness bit. If the head piece is lowered so that the ring and chin strap clear the bit, this obstructs the nostrils of the horse.

In the so-called English nose band, a single chin strap is placed above the harness bit around the chin. In this construction, the lower part of the horse's mouth has too much freedom of movement. Furthermore, the chin strap presses the insides of the cheeks firmly against the teeth. The flesh gets between the teeth and is cut. Moreover, the danger exists that the nose piece will overlie an area where a vein protrudes under the edge of the cheek and press down on the vein to cause bleeding.

The danger of the occurrence of chafe marks exists in the case of both known nose bands.

In the specification, DE-GM 79 08 203, a nose band clamp is disclosed which consists essentially of a straight clamp body with rearwardly-directed eyelets for the nose piece, the head piece and the two chin straps. The eyelets for the nose piece and the head piece are provided with spindles for better anchoring of the nose band. Although this nose band has advantages compared with the previously-disclosed Hannover nose band and the English nose band, it also has disadvantages. The straight clamp body causes chafe marks on the horse's head. If the nose piece is too short, the clamp may constrict the air passages. The harness bit snaffle ring practically always touches the straight nose band clamp, which may result in jamming and lip contusions. Moreover, the activity of the mouth is limited. Since the nose piece and the head piece are mounted in a common eyelet, the head piece sits too far forward, too closely to the horse's eye. A longer nose piece would be no remedy because then the clamp would come into contact with the harness bit. The upper chin strap is practically directly connected with the head piece, because the clamp body is sewn into the head piece in the area of the eyelet. In addition to making more work for the saddle maker, this construction causes the nose band to sit crooked when the chin strap is strapped on. The eyelet for the nose piece is provided with a forwardly-directed spindle which fixes the nose piece too rigidly to the eyelet. It can no longer slip into the correct position by itself. This can lead to chafe marks.

The object of the present invention is to provide a nose band and nose band clamp or bow which obviate the above-described disadvantages, especially the origin of chafe marks on the horse's head and the danger of collision with the harness bit snaffle ring.

According to the invention, this problem is solved by curving the nose band bow in two directions so that it has a crescent shape in the plane of the horse's face against which it lies, and a slight lateral curvature in a plane normal to the horse's face.

Due to this design, the nose band bow fits better on the horse's head. Chafing marks are practically eliminated because the ends of the bow do not lie against the face. The air passages are completely free. No pressure is exerted on them. The air passages are not restricted even if the nose piece is too short. A collision with the harness bit snaffle ring is avoided because the clamp body is spaced from the ring and its crescent shape follows the curve of the ring. The danger of jamming and the danger of lip contusions are competely dispensed with. The design according to the invention permits freer mouth activity of the horse. The improved nose band can be used universally in jumping contests as well as in breaking in or training. The guiding of the horse by means of reins and harness bit is not impaired.

The bow body lies firmly in the middle of the horse's head so that optimum protection of the horse's head is achieved.

In accordance with the invention, the upper chin strap and the head or crown piece can move relatively freely with relation to each other within certain limits. This has the advantage that the head piece is not distorted with tight buckling of the chin strap. A perfect seating of the nose band is effected.

A certain fixing and better anchoring of the chin strap and of the head piece are achieved by means of spindles radially-extending from the upper eyelet to which the straps are secured. But the anchoring still permits sufficient movement for the head piece so that accurate seating of the nose band is not endangered even with tightening of the chin strap.

In a preferred form of the invention, a middle eyelet without a spindle is provided for the nose piece. This has the advantage that the nose piece will slip automatically into the correct position so that chafe marks and the pressing down of veins protruding under the cheek bone edge are avoided.

The invention will be explained in more detail by reference to the drawings.

FIG. 1 is a view of a horse's head which has a nose band according to the invention strapped on.

In the figures of the drawing, the same parts of the nose band are designated by the same reference numerals.

Figure 1:
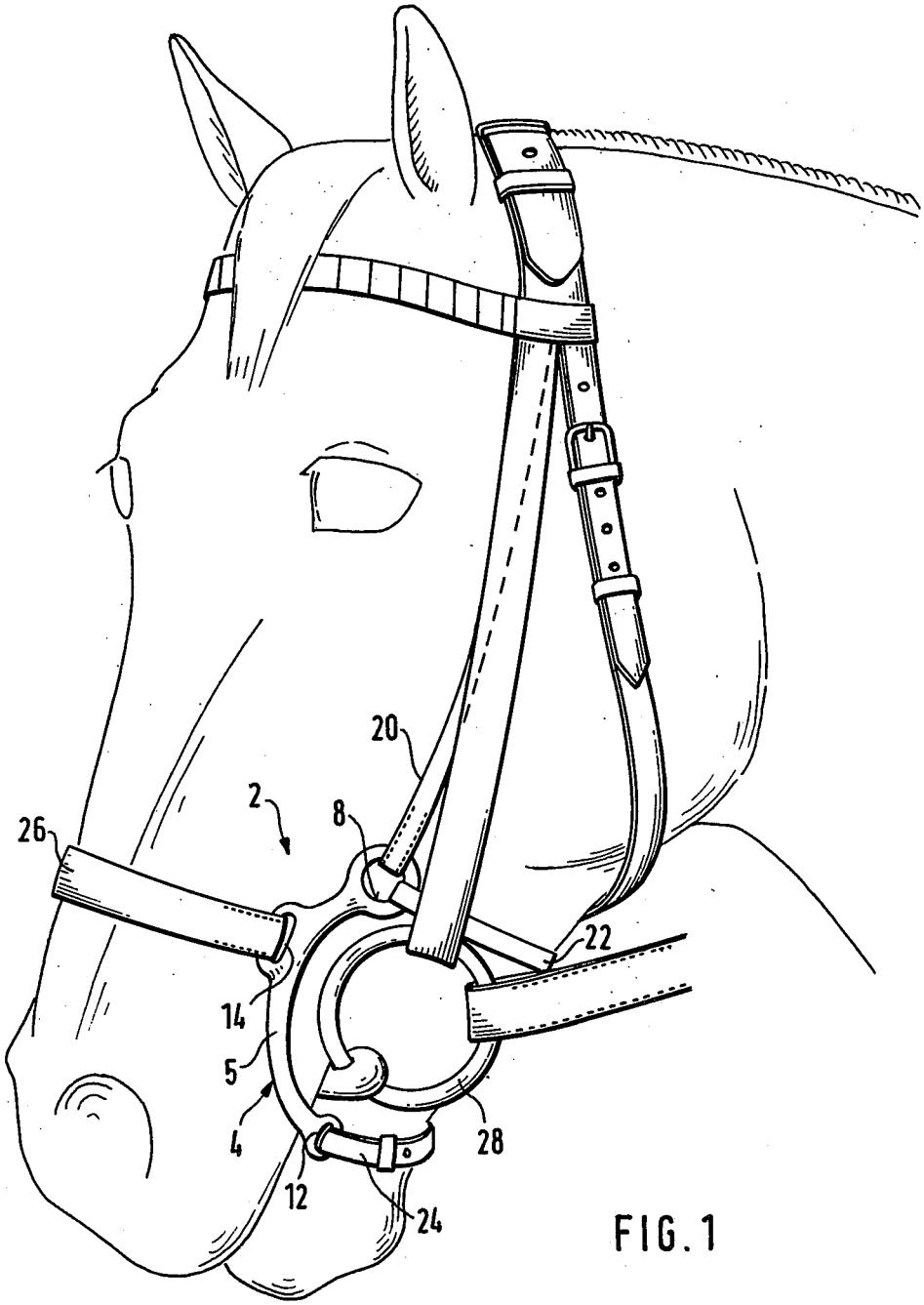
Figure 2:
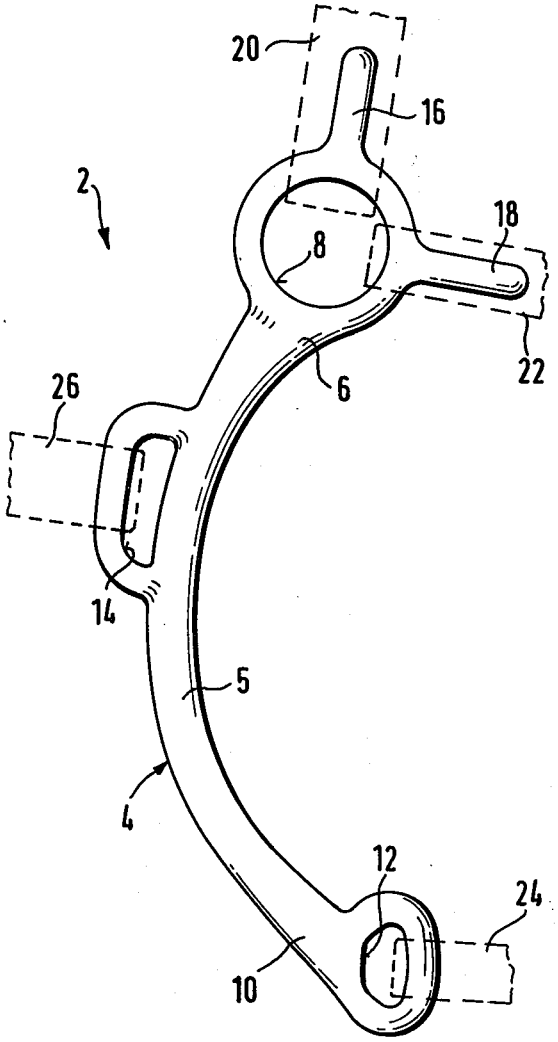
FIG. 2 is a side top view of a nose band clamp or bow formed according to the invention.

The drawings show a nose band 2 with a nose band bow 4 having a bow body 5. On the upper end 6 of the bow body 5 there is an eyelet 8 and on the lower end 10 there is an eyelet 12. The upper eyelet 8 is round and the lower eyelet 12 is oval. A forwardly-directed eyelet 14 is provided which has a rectangular opening.

A head or crown piece 20 and a chin strap 22 are mounted in eyelet 8.

The upper eyelet 8 may have an upwardly-directed primary spindle 16 extending from the upper side of the eyelet in the direction of the head piece and a downwardly-directed secondary spindle 18 extending laterally from the eyelet in the direction of the chin strap.

The spindles 16 and 18 may be sewn into the head piece 20 and into the chin strap 22 and provide a certain fixing of the position of the nose band parts and a better anchoring of these parts.

Another chin strap 24 is fastened to the lower eyelet 12.

Figure 3:
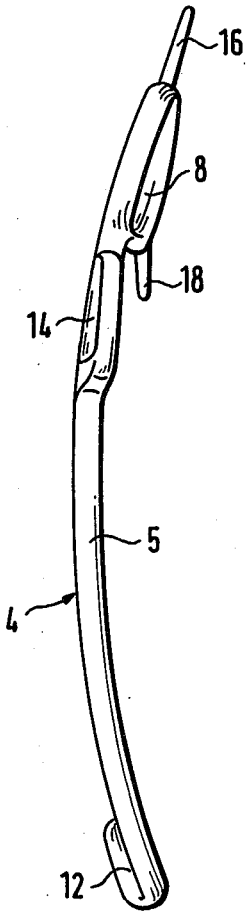
FIG. 3 is a front view of the nose band bow of FIG. 2, illustrating the lateral curvature of the bow body.

Eyelet 14 is provided for a nose piece 26 of halter 2. The nose band bow 4 is bent in a crescent shape so that both ends 6 and 10 extend backward. At the same time, the bow is curved laterally, that is to say away from the horse's head when the nose band is strapped on, as is evident in FIG. 3. The lateral curvature is less than the backward curvature. The eyelet 14 is preferably disposed in the upper half of the body 5 below eyelet 8.

It is clear from FIG. 1 that the nose band bow 4 follows the curve of the snaffle harness bit ring 28 and is spaced therefrom so that the danger of collision does not exist.

The upper eyelet 8 lies relatively far back so that the head piece 20 is located farther from the horse's eye than is the case with previously used nose bands. The head piece 20 is almost covered by the cheek piece of the harness bit snaffle.

The nose piece 26 is not fixed in eyelet 14 by a spindle, so it can automatically assume the most favorable position to avoid unintentional pressure on the nose bag or in the veins of the horse's head normally protruding in the area of the cheek bone edge.

The upper chin strap 22 and the head piece 20 are arranged in the upper eyelet 8 relatively movable with relation to each other so that even when the chin strap is tightened, a distortion of the head piece and thus of the nose band itself is not possible.

The nose band bow 4 is preferably cast from metal. Suitable materials for example are high grade steel, metal alloys like German silver, but also plastic. Of course it is also possible to make the bow body 5 separately and then weld the eyelets and the spindles on the body.

I claim:

1. A nose band including a nose band bow having a longitudinal bow body, a head piece, a nose strap, and two chin straps, said head piece and one of said chin straps being connected to an upper eyelet at one end of said bow, said other chin strap being connected to a lower eyelet at the lower end of the bow, and said nose strap being connected to another eyelet located between the ends of the nose band bow just below said upper eyelet, characterized in that the body of the nose band bow is crecent-shaped and has its upper and lower ends bent backwardly and laterally away from the horse's head when the nose band is strapped, the curvature and the location of the bow body in the strapped position party surrounding, in spaced relationship, a bit and a bit ring of a bridle.

2. The nose band of claim 1 in which said lateral bend is smaller than the curvature of the crescent.

* * * * *